United States Patent [19]

Booker

[11] 4,400,133

[45] Aug. 23, 1983

[54] SHIPS SCREW AND RUDDER REMOVAL APPARATUS

[76] Inventor: Arthur J. Booker, Rte. 1, Box 73, Zuni, Va. 23848

[21] Appl. No.: 300,591

[22] Filed: Sep. 9, 1981

[51] Int. Cl.[3] ..... B63B 3/00

[52] U.S. Cl. ..... 414/589; 414/718; 414/427; 414/471; 414/10; 114/65 R

[58] Field of Search ..... 414/589, 590, 680, 426–428, 414/471, 477, 495, 718, 607, 10, 11; 114/270, 222, 65 R; 440/112

[56] References Cited

U.S. PATENT DOCUMENTS

| | | | |
|---|---|---|---|
| 2,395,411 | 2/1946 | Kittel | 414/589 |
| 2,431,589 | 11/1947 | Shuler, Jr. | 414/607 |
| 2,468,884 | 5/1949 | L'Esperance et al. | 414/663 |
| 2,486,801 | 11/1949 | Sarosdy | 414/589 |
| 3,121,499 | 2/1964 | La Barre, Jr. | 414/542 |
| 3,298,154 | 1/1967 | Behr et al. | 414/10 X |
| 3,409,158 | 11/1968 | Lull | 414/590 |
| 3,524,556 | 8/1970 | Miller | 414/589 |
| 4,036,163 | 7/1977 | Phersson | 440/112 |
| 4,048,936 | 9/1977 | Vchizono et al. | 414/428 X |
| 4,147,263 | 4/1979 | Frederick et al. | 414/718 |

*Primary Examiner*—Robert J. Spar

*Assistant Examiner*—Terrance L. Siemens

*Attorney, Agent, or Firm*—Wilkinson, Mawhinney & Theibault

[57] ABSTRACT

The present disclosure is directed to an apparatus for removing or replacing ships underwater parts such as a screw from the propulsion shaft or the rudder of a ship in a dry dock and transporting it from the ship to a work area. It has a mobile vehicular frame and a pair of spaced apart main cylinder ram lifts pivoted at their base to the vehicular frame, one lying to each side of the ships part either screw or rudder to be removed. The part receiving and cradling apparatus is mounted at the upper ends of said main cylinder ram lifts. Auxiliary tilt cylinders and rams each having one end pivoted to said vehicular frame and the other end pivotally connected to tilt the main cylinder and ram lifts toward and away from the ships part to be removed from or replaced on the ship. Hydraulic apparatus is carried by said vehicular frame for raising and lowering the vehicular frame upwardly toward and downwardly away from the ship and hydraulic apparatus for longitudinally shifting said vehicular frame forwardly or rearwardly along the major axis of the ship is provided to align the part receiving apparatus therewith and to remove it.

10 Claims, 11 Drawing Figures

SHIPS SCREW AND RUDDER REMOVAL APPARATUS

TECHNICAL FIELD

The present disclosure is directed to an apparatus for working in a dry dock to remove large heavy ships screws varying between 10 and 20 ft. in diameter and weighing from 10 to 25 tons. It is a mobile vehicular device having a pair of main vertical free ends of the main lift rams, auxiliary tilt cylinders connected between the vehicular frame and the main lift rams for positioning the cradling mechanism to properly receive either the screw or the rudder and under the hydraulic power of the vehicle to transport either to a work area.

BACKGROUND ART

Heretofore vehicles have transported light weight propellers for aircraft but I am not aware of apparatus of the type shown and described herein prior to my invention. The best art known to me at the filing of this application for Letters Patent are:

U.S. Pat. No. 2,389,411 Kittle;
U.S. Pat. No. 2,431,589 Shuler;
U.S. Pat. No. 2,468,884 L'Esperance;
U.S. Pat. No. 3,121,499 La Barre Jr.;
U.S. Pat. No. 3,524,556 Miller;
U.S. Pat. No. 4,036,163 Phersoon;

DISCLOSURE OF THE INVENTION

In accordance with my invention I provide a mobile vehicular apparatus which may be driven in a dry dock and placed in position under either a large ships screw to be removed from the main propulsion shaft or the rudder. I provide means for stabilizing the vehicle and for coming up under either the screw or rudder preparatory to their being disconnected for removal and to carry the full load of either which may be many tons.

In the case of the screw I provide a cradle with cut out to accommodate the varying sizes of hubs on ships screws. The vehicle may then after removal of the screw hub cap and key be hydraulically shifted to remove the screw axially from the shaft.

In the case of the rudder the vehicle with rudder supports and straps may be properly aligned with the rudder until the weight of the rudder is on the rudder supports and it is strapped in place, disconnected from the ship, lowered clear of the ship and then transported to a work area.

THE BEST MODE FOR CARRYING OUT THE INVENTION

Figure 1:
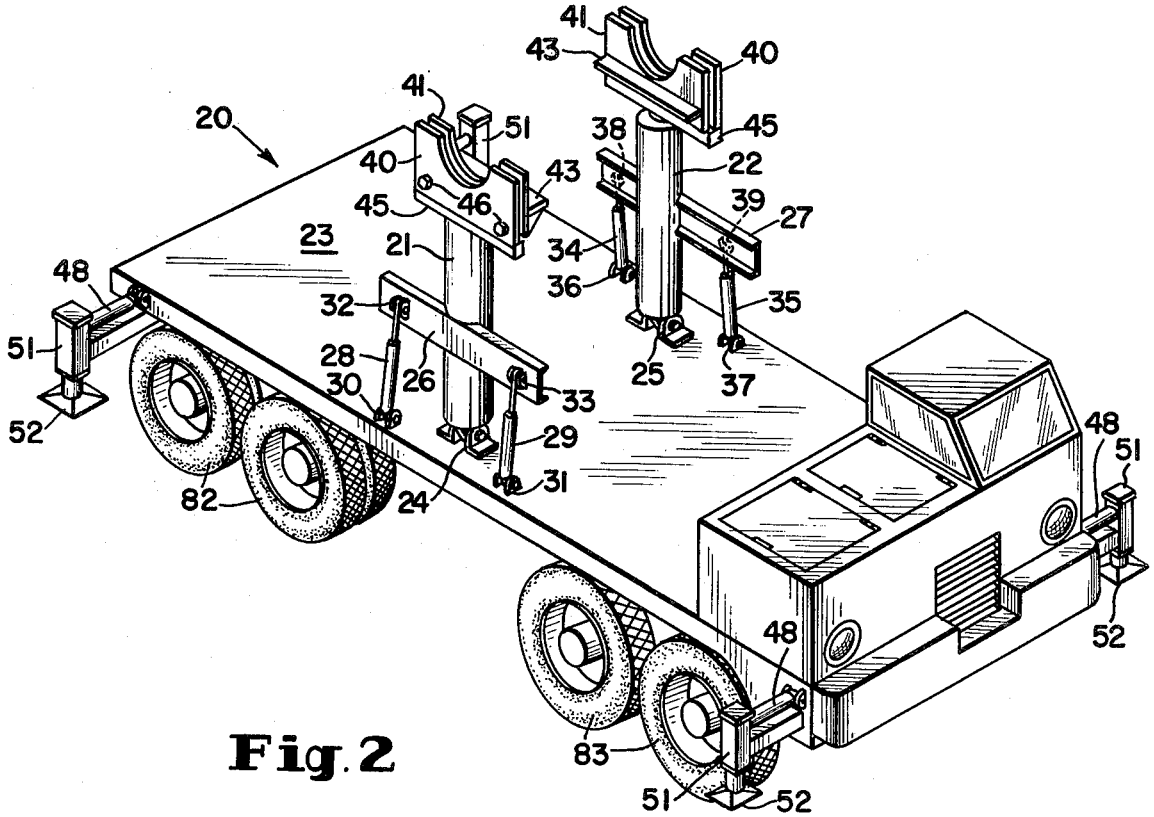
FIG 1. is a perspective view of the apparatus of the present invention.
Figure 2:
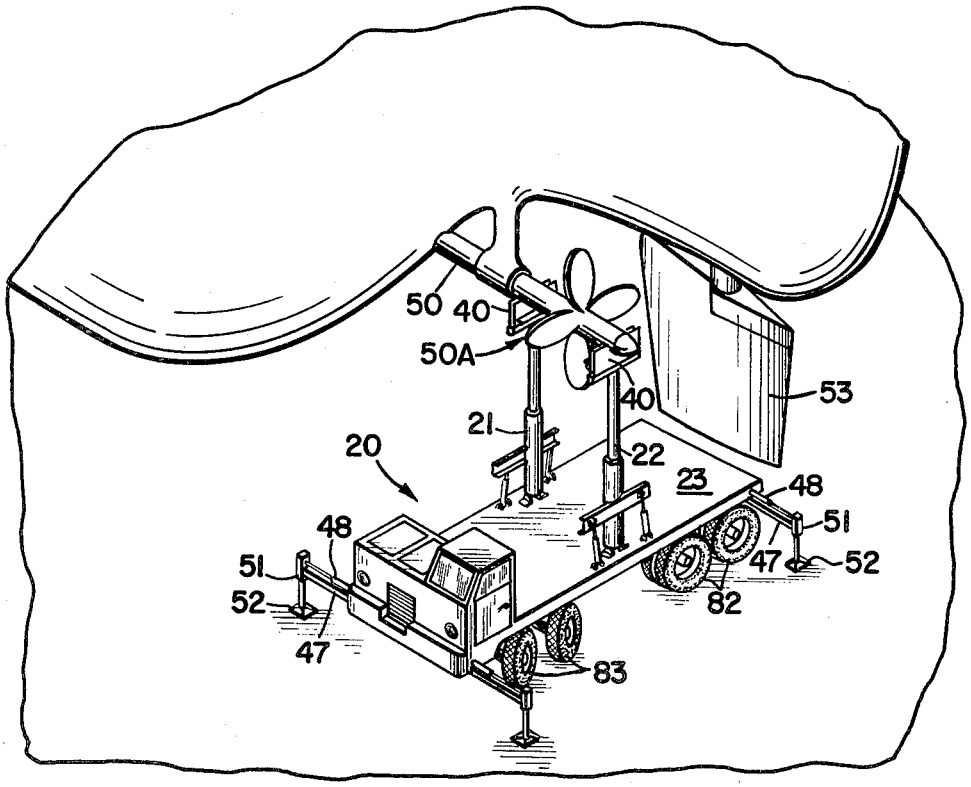
FIG. 2 is a perspective view of the apparatus of the present invention in position to remove a screw from a vessel or ship in dry dock.
Figure 7:
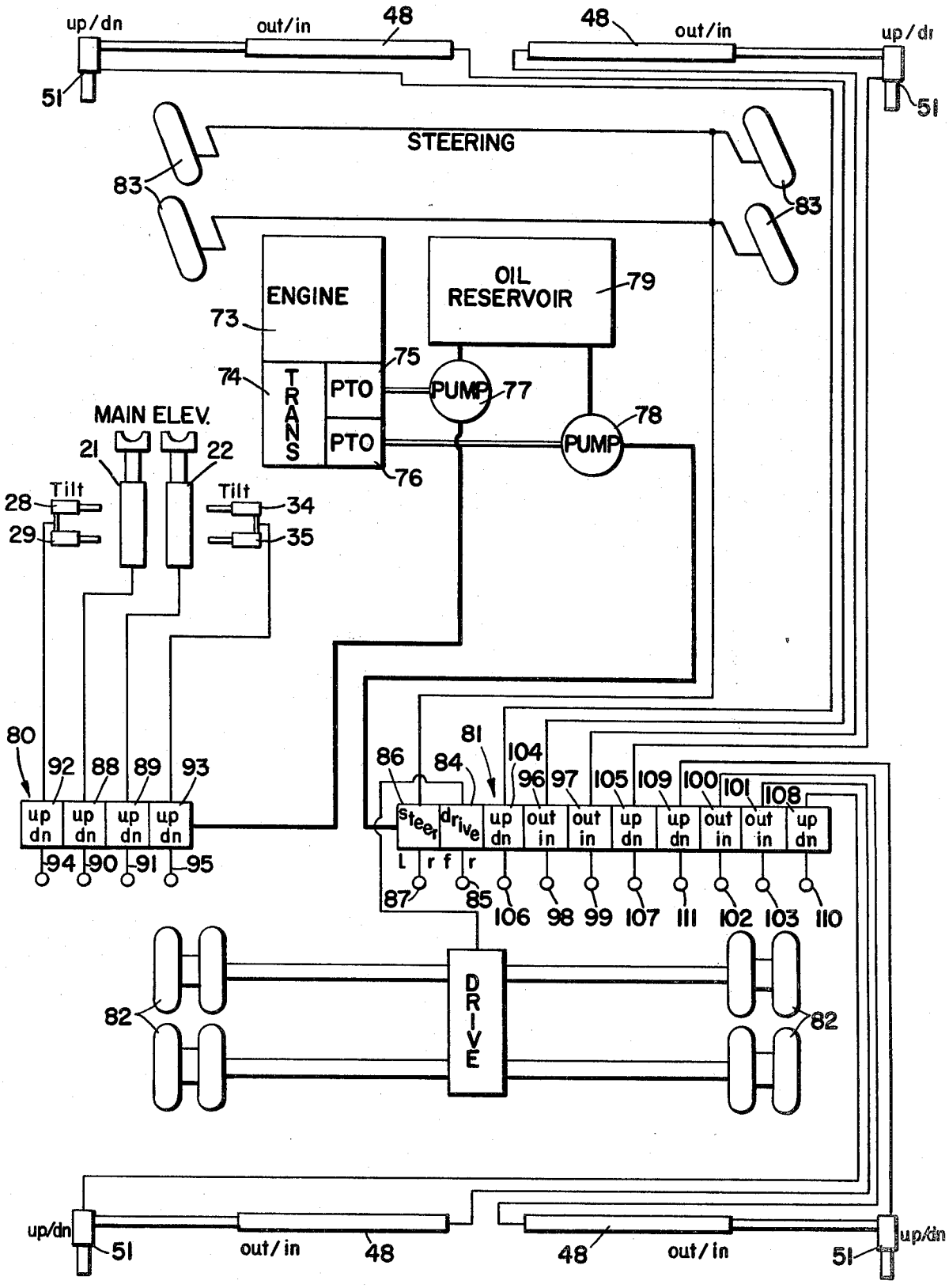
FIG. 7 is a hydraulic schematic of the apparatus of the present invention.
Figure 8:
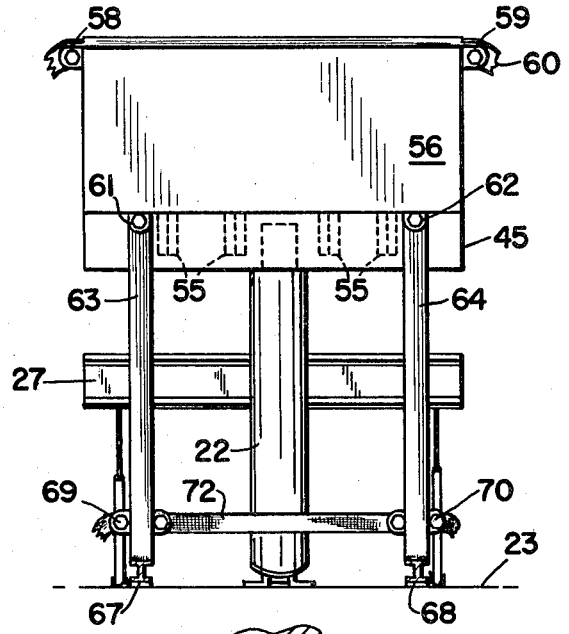
FIG. 8 is a vertical sectional view of the rudder cradling means of the present invention taken on line 8—8 in FIG. 9.

Referring now to FIGS. 1 and 2, 20 designates a mobile vehicular frame of the self-propelled type, see FIG. 7, having a pair of spaced apart main cylinder-ram lifts 21, 22 pivoted to a base structure 23 at 24, 25 respectively. Each cylinder 21, 22 has a beam 26, 27 welded or otherwise secured thereto. A pair of auxiliary tilt cylinder and ram units 28, 29 have one end pivotally connected to the base structure 23 at 30, 31 and the other end pivotally connected to the beam 26 at 32, 33 while an identical pair of auxiliary tilt cylinders 34, 35 each have one end pivotally connected to the base structure 23 at 36, 37 and their other end is pivotally connected to the beam 27 at 38, 39.

Figure 3:
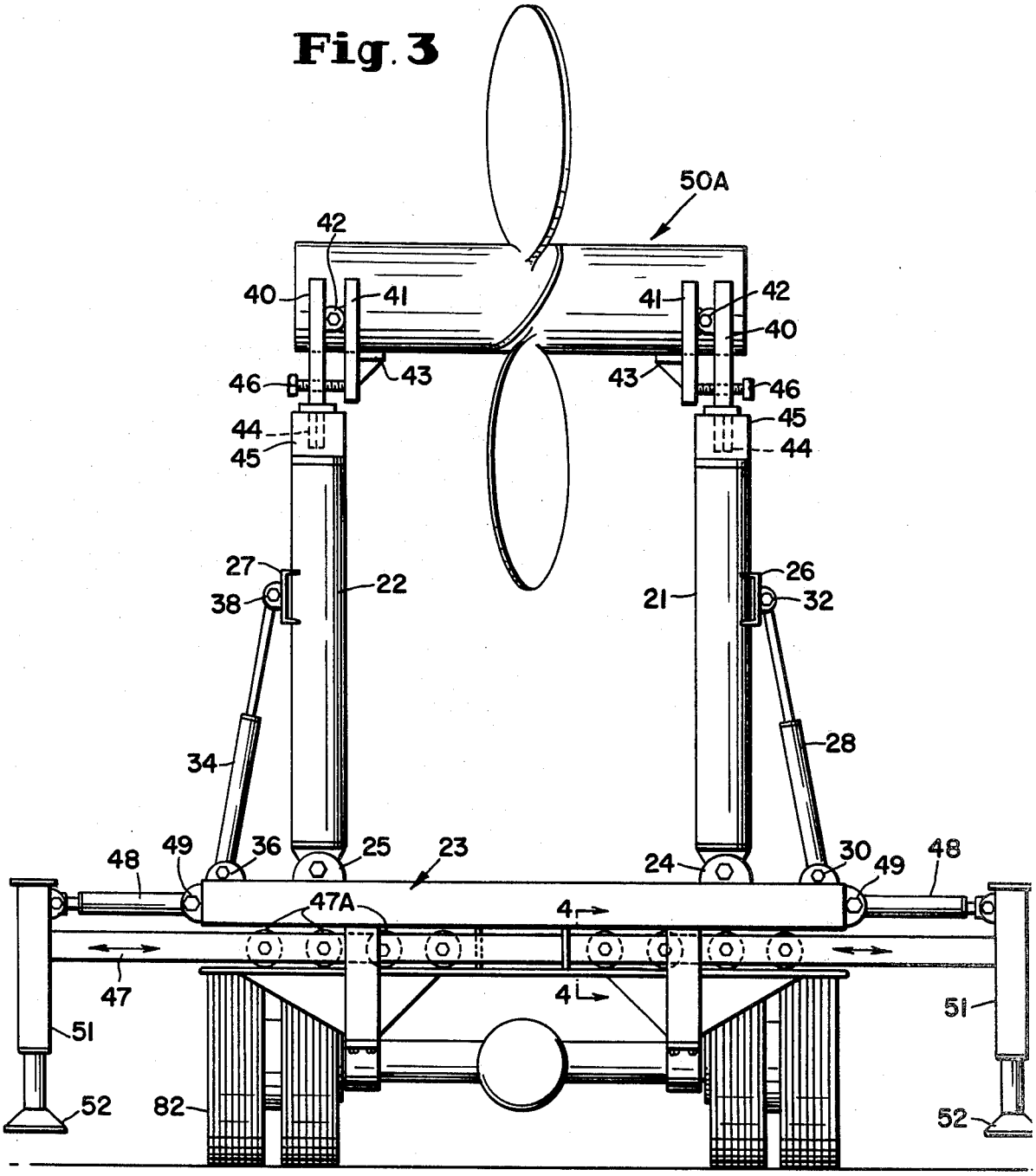
FIG. 3 is a rear elevational view of the apparatus of the present invention with the screw of FIG. 2 in place.
Figures 5, 6:
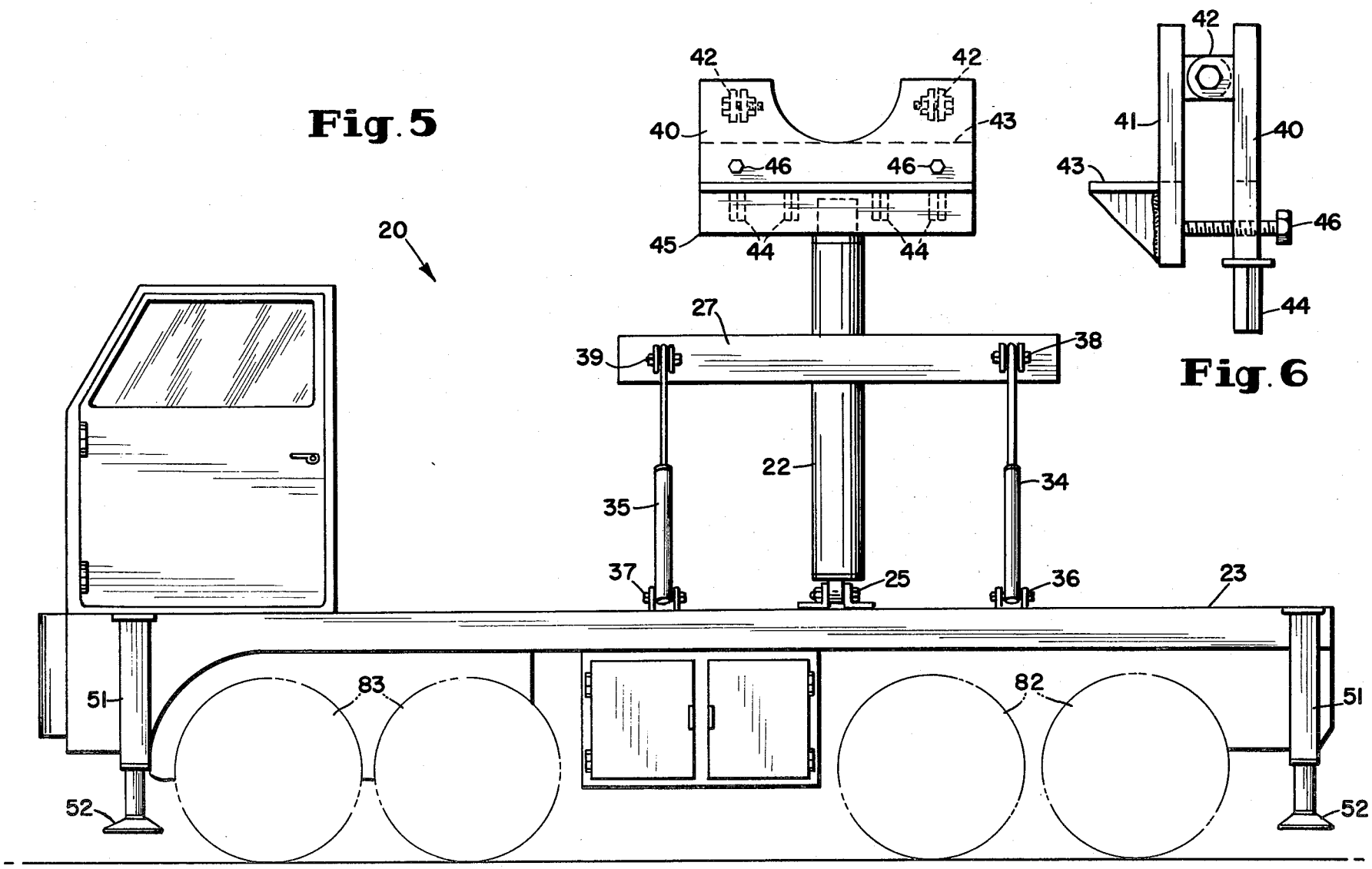
FIG. 5 is a side elevational view of the apparatus of FIG. 1.
FIG. 6 is a side elevational view of the screw and cradling means employed with the present invention.

Referring now to FIGS. 3, 5 and 6, the part receiving and cradling means is shown having a pair of plates 40, 41 pivoted at 42 proximate their upper ends. The plate 41 has a screw hub conforming and load transfer shelf 43 while plate 40 has a plurality of anchor projections 44 which removably seat in a load transfer beam 45 secured to the upper end of the rams of the main cylinder and ram lifts 21, 22. Each plate 40 has a threaded adjusting bolt 46 the free end of which bears against the base of plate 41 to assist in conforming to the screw or propeller hub.

Figure 4:
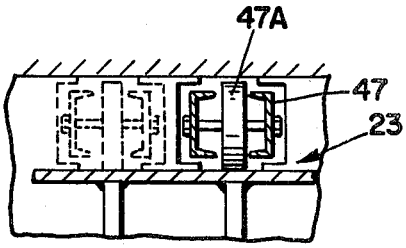
FIG. 4 is a vertical sectional view taken on the line 4—4 in FIG. 3 showing the telescopically hydraulic extensible supports carried by the vehicular frame having roller support for the vehicular frame.

Referring now to FIGS. 3 and 4, 47 designates a plurality of telescopically hydraulic extensible support members which are extended by hydraulic cylinder and ram units 48 which extend the support members or retract them toward the vehicle base structure 23. While the cylinder and ram units 48 are shown pivotally connected externally of the base structure at 49 they may be mounted beneath the base structure 23 to bring the support members closer to the base 23 to reduce transverse width of the vehicle for over the road transport. The support members 47 have rollers 47A mounted on bearings, FIG. 4, to support the weight of the vehicle on the members 47 and to permit moving or shifting the base 23 and its topside structure under action of the cylinder and ram units 48 when the entire vehicle structure is elevated clear of the ground or bottom of the dry dock. This structure is for shifting the vehicular structure 23 forwardly or rearwardly along the major axis of the ship to align the part cradling receiving means with the screw and to move the screw rearwardly of the propulsion shaft 50 after it has been disconnected therefrom.

Referring now to FIGS. 3 and 5, the means carried by the vehicular frame for raising and lowering the vehicular frame clear of the ground, toward and away from the ship are a plurality of cylinder and ram units 51, the cylinder of which is rigidly secured to the extensible members 47 and the ram of which has load bearing transfer pads 52 for solid contact with the bottom of the dry dock or ground. With extensible members 47 extended the cylinder units 51 activated to push the rams downwardly so that the pads 52 engage the ground, the vehicular frame may be elevated to permit it to be moved to the right in FIG. 2 to remove the screw 50A from the propulsion shaft 50 after the hub and key have been removed.

Figure 9:
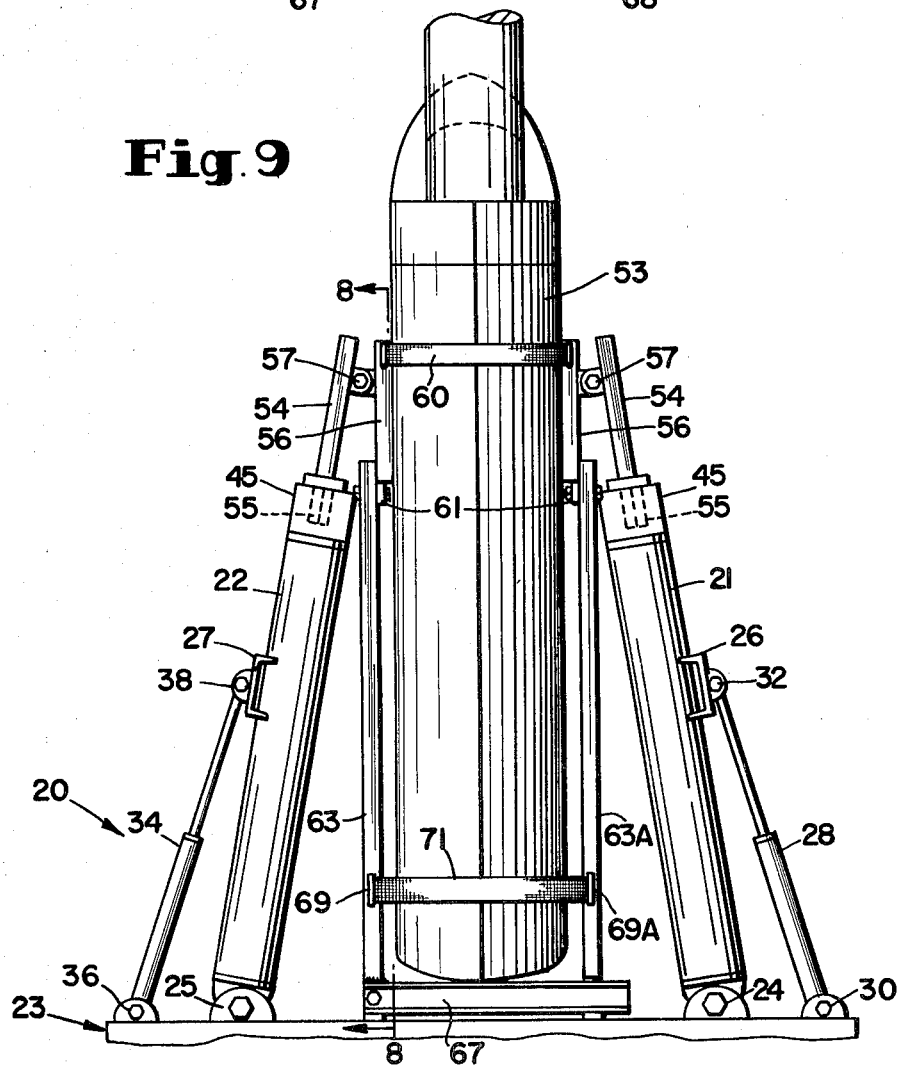
FIG. 9 is a vertical transverse view of the rudder cradling means showing the position of the rudder between the main cylinder ram lifts.

Referring now to FIGS. 8 through 11, the modification for removing and transporting the rudder 53. The vehicular structure 20, 23 is the same as shown in FIGS. 1 through 5. The structure above the load transfer beam 45 has a plate 54 having plate anchor projections 55 which engage the load transfer beam 45 and a plate 56 is pivoted to plate 54 at 57 similar to the structure of FIG. 6 but without the shelf 43. The plate 56 has attaching pads 58, 59 to which a rudder strap 60 may be bolted or otherwise secured. The bottom of plate 56 has a pair of support pads 61, 62 to which rudder supports 63, 64 are pivoted. As shown in FIG. 9 there are two such pivoted plate units, one for lift 21 and one for lift 22. There are four rudder vertical support members 65, 65A, 66 and 66A which are joined at their base by I-beam rudder transverse supports 67, 68. The vertical rudder supports 65, 66, 65A, 66A have pads 69, 70, 69A, 70A to which lower rudder anchoring straps 71, 72 and 71A, 72A are secured.

Since the rudder 53 is not as thick transversely as the screw 50A is long the tilt cylinders, best seen in FIG. 3, are moved to bring the main cylinder lifts 21, 22 toward each other. This can be readily accommodated at the top of the rudder but the transverse rudder support 65, 66 will have to pass freely through one pair of rudder vertical supports 63, 64 while being pivotally secured to the other supports 63A, 64A.

Referring now to FIG. 7, the motive power and control system for the present invention is shown. The prime mover 73 is an engine of either the gasoline or diesel type having a transmission 74 and two power take offs 75, 76 which drive hydraulic pumps 77, 78 which receive hydraulic oil from a sump 79. Each pump 77, 78 supplies a valve control manifold 80, 81.

The propulsion and steering mechanism controls the rear traction wheels 82 and the front steering wheels 83. Valve 84 under control of lever 85 controls moving the vehicle forward and reverse while valve 86 under control of lever 87 steers the vehicle either left or right.

The main cylinder and ram lifts 21, 22 are controlled by valves 88, 89 operated by levers 90, 91 respectively.

The auxiliary tilt cylinders 28, 29 and 34, 35 for main lift ram 21, 22 are controlled by valves 92, 93 under control of levers 94, 95.

The cylinder and ram units 48 for extending the extensible support members 47 for shifting the vehicular frame 20 forwardly or rearwardly along the axis of the screw 50A or rudder 53 are controlled by valves 96, 97 under control of levers 98, 99 for the forward members while valves 100, 101 under control of levers 102, 103 control the extension of the aft members 47.

The cylinder and ram units 51 for raising and lowering the vehicular frame upwardly toward or downwardly away from the ships screw 50A or rudder 53 are controlled by valves 104, 105 under control of levers 106, 107 for the forward units 51 while valves 108, 109 under control of levers 110, 111 control the aft lift units 51.

Figure 10:
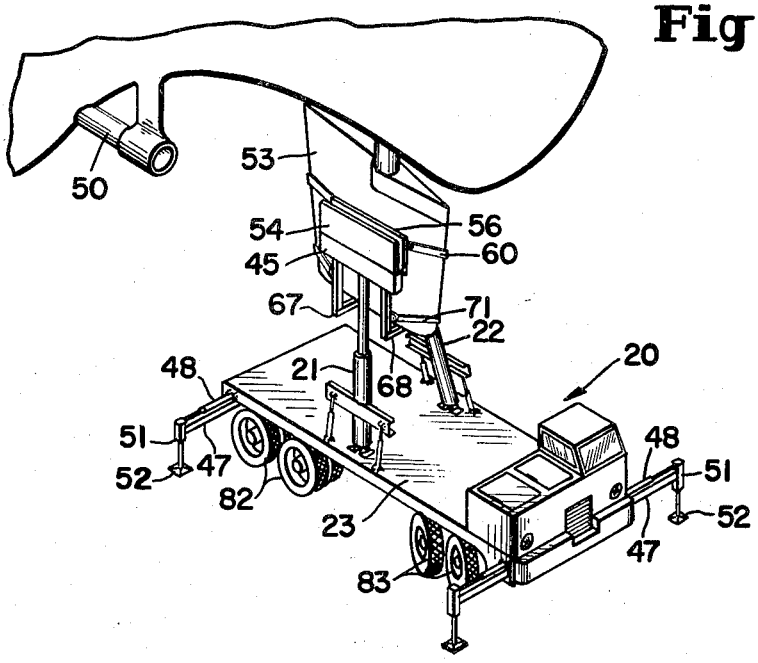
FIG. 10 is a perspective view of the apparatus of the present invention in position in a dry dock removing the rudder from a ship.
Figure 11:
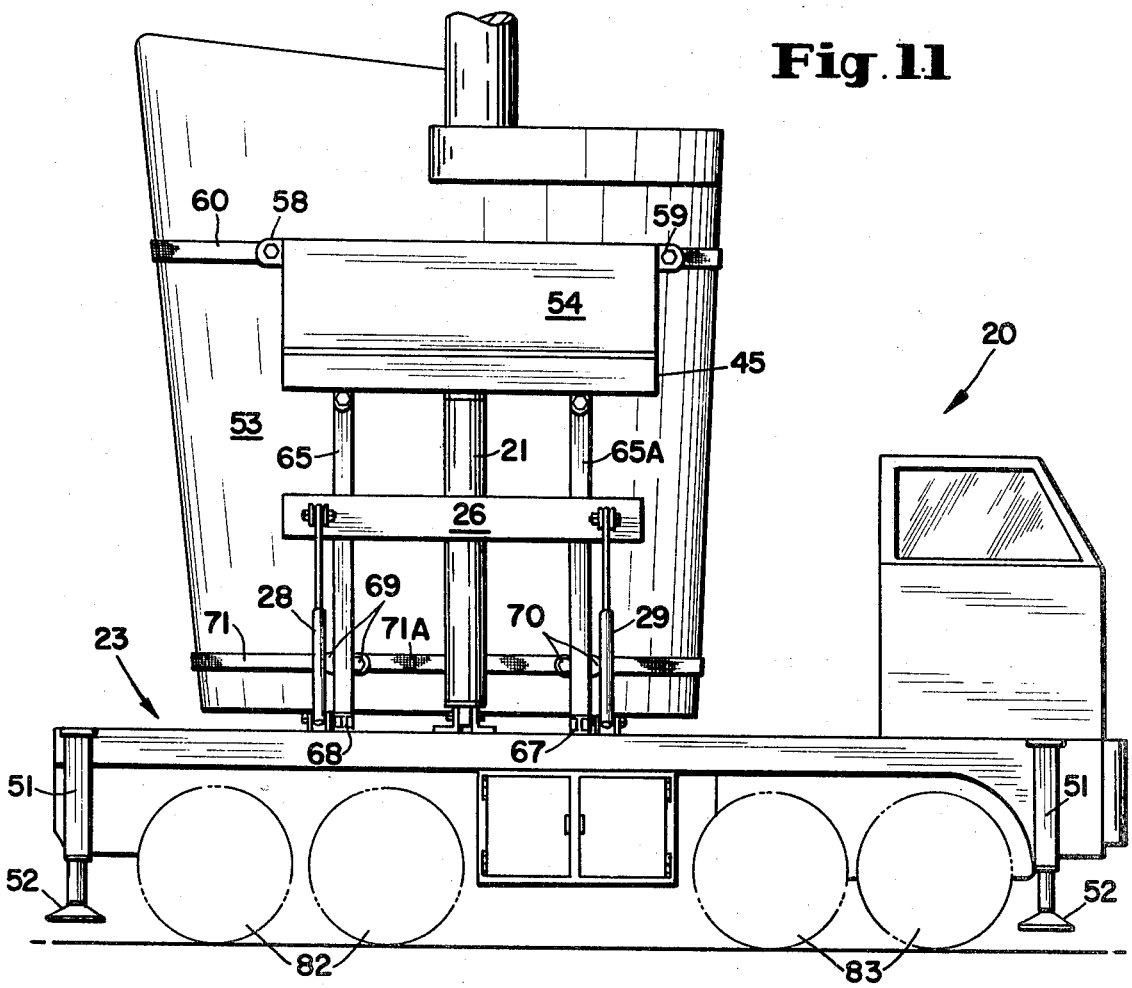
FIG. 11 is a side elevational view of the apparatus of the present invention transporting a rudder removed from a vessel.

In operation the vehicle is first positioned as shown in FIGS. 2 and 10 for removal of either the screw 50A or rudder 53. The extensible support members 47 are extended and the cylinder ram units 51 are lowered to lift the vehicular frame 23 clear of the ground or dry dock and after the breaking of connections between either the rudder 53 or screw 50A have been assured they are removed by either raising or lowering of the vehicle or shifting the vehicle along the axis of the propulsion shaft 50 to clear the screw 50A from the shaft whereafter it is transported to a work area.

The main cylinder-ram lifts 21, 22 are raised to bring the part receiving means into registry with either the screw 50A or rudder 53. The main lifts 21, 22 do the greater adjustment as to height while the cylinder ram lifts 51 are a vernier adjustment in height but are mainly to lift the vehicle clear of the ground so the entire unit may be moved relative to the screw or rudder along the major axis of the ship from which either is to be removed.

What is claimed:

1. An apparatus for removing or replacing ships underwater parts such as a screw from the propulsion shaft or the rudder of a ship in a dry dock and transporting it from the ship to a work area comprising:

(a) a mobile vehicular frame, (b) a pair of spaced apart main cylinder ram lifts pivoted at their base to the vehicular frame, one lying to each side of the ships part to be removed, (c) part receiving and cradling means mounted at the upper ends of said main cylinder ram lifts, (d) auxiliary tilt cylinder and ram means having one end pivoted to said vehicular frame and the other end pivotally connected to tilt said main cylinder ram lifts toward and away from the ships part to be removed from or replaced, (e) hydraulic means carried by said vehicular frame for raising and lowering said vehicular frame upwardly toward and downwardly away from the ship, (f) and hydraulic means for longitudinally shifting said vehicular frame forwardly or rearwardly along the major axis of the ship to align the part receiving means therewith and to remove it.

2. An apparatus as claimed in claim 1 wherein said part receiving and cradling means comprises a pair of plates, a first plate secured to the upper end of said main cylinder ram lifts, a second plate pivoted to said first plate for movement at their upper ends, screw hub recesses in the top surfaces of both plates, hub contact bearing means carried by said movable plate, and adjusting means carried by the bottom of said plates for varying contact with the hubs of varying size screws.

3. An apparatus as claimed in claim 1 wherein said hydraulic means for longitudinally shifting said vehicular frame forwardly or rearwardly of the ships major axis are telescopic hydraulically extensible supports carried by said vehicular frame and having roller support means for said vehicular frame and carrying said hydraulic means for raising and lowering said vehicular frame toward and away from the ship.

4. An apparatus as claimed in claim 3 wherein said hydraulic means for shifting the vehicular frame forwardly or rearwardly are hydraulic jacks secured to the ends of said telescopic hydraulically extensible supports for the vehicle frame.

5. An apparatus as claimed in claim 1 wherein said part receiving and cradling means further comprises support and strapping means for receiving and transporting the rudder of a ship removed from the ships hull.

6. An apparatus for removing or replacing ships screw from the propulsion shaft of a ship in a dry dock and transporting it from the shaft to a work area comprising:

(a) a mobile vehicular frame, (b) a pair of spaced apart main cylinder ram lifts pivoted at their base to the vehicular frame, one lying to each side of the ships screw to be removed, (c) screw receiving and cradling means mounted at the upper ends of said main cylinder ram lifts, (d) auxiliary tilt cylinder and ram means having one end pivoted to said vehicular frame and the other end pivotally connected to tilt said main cylinder ram lifts toward and away from the ships screw to be removed from or replaced on the shaft, (e) hydraulic means carried by said vehicular frame for raising and lowering said vehicular frame upwardly toward and downwardly away from the ships screw, (f) and hydraulic means for longitudinally shifting said vehicular frame forwardly or rearwardly along the axis of the screw and propulsion shaft to align the screw receiving means therewith and to remove it along the propulsion shaft.

7. An apparatus as claimed in claim 6 wherein said screw receiving and cradling means comprises a pair of plates, a first plate secured to the upper end of said main cylinder ram lifts, a second plate pivoted to said first plate for movement at their upper ends, screw hub recesses in the top surfaces of both plates, hub contact bearing means carried by said movable plate, and adjusting means carried by the bottom of said plates for varying contact with the hubs of varying size screws.

8. An apparatus as claimed in claim 6 wherein said hydraulic means for longitudinally shifting said vehicular frame forwardly or rearwardly of the ships major axis are telescopic hydraulically extensible supports carried by said vehicular frame and having roller support means for said vehicular frame and carrying said hydraulic means for raising and lowering said vehicular frame toward and away from the ship.

9. An apparatus as claimed in claim 8 wherein said hydraulic means for shifting the vehicular frame forwardly or rearwardly are hydraulic jacks secured to the ends of said telescopic hydraulically extensible supports for the vehicle frame.

10. An apparatus as claimed in claim 6 wherein said part receiving and cradling means further comprises support and strapping means for receiving and transporting the rudder of a ship removed from the ships hull.

* * * * *